US011359880B2

(12) United States Patent
Nolte

(10) Patent No.: US 11,359,880 B2
(45) Date of Patent: Jun. 14, 2022

(54) DUST COVER ASSEMBLY FOR A FIREARM

(71) Applicant: GLOCK TECHNOLOGY GMBH, Ferlach (AT)

(72) Inventor: Patrick Nolte, Klagenfurt (AT)

(73) Assignee: Glock Technology GmbH, Ferlach (AT)

( * ) Notice: Subject to any disclaimer, the term of this patent is extended or adjusted under 35 U.S.C. 154(b) by 1 day.

(21) Appl. No.: 17/124,234

(22) Filed: Dec. 16, 2020

(65) Prior Publication Data

US 2021/0180907 A1 Jun. 17, 2021

(30) Foreign Application Priority Data

Dec. 17, 2019 (EP) ..... 19216893

(51) Int. Cl.
*F41A 35/02* (2006.01)

(52) U.S. Cl.
CPC ..... *F41A 35/02* (2013.01)

(58) Field of Classification Search
CPC ..... F41A 35/02; F41A 11/00; F41A 15/00; F41A 15/12; F41A 3/66; F41A 35/06
USPC ..... 42/16, 71.01, 96, 99; 89/30
See application file for complete search history.

(56) References Cited

U.S. PATENT DOCUMENTS 4,044,487 A 8/1977 Hutton
4,057,003 A * 11/1977 Atchisson ..... F41A 9/68 89/142
4,972,617 A * 11/1990 Major ..... F41A 3/80 89/197
5,038,666 A * 8/1991 Major ..... F41A 3/80 89/197
5,239,911 A * 8/1993 Ostor ..... F41A 15/16 42/105
5,293,708 A * 3/1994 Strayer ..... F41C 23/10 42/71.02
6,345,463 B1 * 2/2002 Baer, Sr. ..... F41C 27/22 42/97
7,181,881 B2 2/2007 Fischbach
7,194,836 B1 * 3/2007 Urban ..... F41C 27/22 89/14.05
9,086,247 B2 7/2015 Lessard
9,612,075 B1 4/2017 Stephens, IV
10,393,467 B1 8/2019 Ding
(Continued)

OTHER PUBLICATIONS

EP Search Report established in related EP application No. 19216893.8, dated Jun. 17, 2020.

*Primary Examiner* — Michael D David
(74) *Attorney, Agent, or Firm* — Raven Patents, LLC; Anton E Skaugset

(57) ABSTRACT

Dust cover assembly for a firearm, including a dust cover, a first bushing and a second bushing, a pin guided in the first bushing with pin end and a cover spring. The dust cover assembly lends itself to tool-free mounting/dismounting and disassembly/assembly, as the assembly is configured so that the pin is received spring-preloaded in the axial direction at least in the first bushing and a guide extension for interacting with a guide groove and an insertion groove of the first bushing is formed on the pin. An insertion groove can be formed parallel to the axis of rotation of the pin on the inside of the first bushing, which begins at the outer end of the bushing and ends at the guide groove and is connected to the guide groove.

20 Claims, 6 Drawing Sheets

(56) References Cited

U.S. PATENT DOCUMENTS

| | | | | |
|---|---|---|---|---|
| 2011/0209607 | A1* | 9/2011 | St. George | F41A 3/26<br>89/191.01 |
| 2015/0285579 | A1 | 10/2015 | Hawley | |
| 2020/0256636 | A1* | 8/2020 | Martini | F41A 3/66 |

* cited by examiner

DUST COVER ASSEMBLY FOR A FIREARM

TECHNICAL FIELD

The disclosure is directed to ejection port dust covers for firearms, and in particular ejection port dust covers for automatic and semi-automatic rifles.

BACKGROUND

For automatic and semi-automatic firearms, such as the M4/M16- or AR15-based systems, the (semi)automatic reloading process is performed by moving the bolt backward and forward. During its backward movement, the bolt engages the spent cartridge case with an extractor and pulls it out of the chamber towards the rear. When the cartridge case becomes aligned with an ejection port in the housing of the weapon, the spring-prestressed ejector urges the spent casing out of the weapon through the ejection port. The ejection port must therefore be open and offer the casing a barrier-free path out of the weapon at this point in the firing cycle.

However, an ejection port that remains permanently open is strongly disadvantageous, as moisture, sand, mud, other contaminants, and other environmental influences can easily reach into the interior of the weapon through the open port, and in particular into the area of the mechanically sensitive bolt mechanism. Such contamination can subsequently lead to increased friction, making reloading more difficult, and increasing the tendency of the weapon to jam. In addition, dust, sand, etc. can exert a highly abrasive effect and thus promote premature and unwanted material wear on the firing mechanism.

For this reason, many such firearms include an ejection port cover, or dust cover, that is only opened or removed during firing. In this way, the penetration of dirt and other contaminants can be prevented or at least minimized. Such dust covers can be opened and closed, and are typically removable.

The dust cover described in U.S. Pat. No. 9,612,075 B1 to Stephens, I V is removably mounted on a firearm, and may have two or more positions. However, during mounting or disassembly of the dust cover, it is necessary to simultaneously squeeze two retractable pins against the force of springs, an operation that may be challenging under field conditions.

The dust covers of U.S. Pat. No. 10,393,467 B1 and, similarly, US Publ. no. 2015/0285579 A1 require the user to tamper with small prongs of a spring in order to mount or disassemble the dust cover, a process that can be even more challenging under field conditions.

EP 1 893 933 A2 describes a dust cover for the M4/M16/AR15 system (see for example FIGS. 4, 5). The disclosed dust cover can be swiveled around a simple pin and is connected to the firearm housing by this pin. The pin is mounted in two end recesses and is prevented from falling out by safety pins. The pin, and therefore the dust cover, can only be removed with considerable effort and with the aid of tools after the safety pins have been removed. It is not possible to replace the dust cover quickly without tools.

U.S. Pat. No. 7,181,881 B2 discloses a dust cover that includes a magnetic closing mechanism on a rifle of the so-called "Bullpup" design. The dust cover is attached to the firearm housing so that it can be swiveled about an axis and close the ejection port accordingly when closed. The dust cover is held closed by magnets both in the cover and in the housing, which means that production of the mechanism is very complex. There is no description with regard to a possibly necessary exchange of the dust cover.

A rotating mechanism for a self-opening and self-closing dust cover according to the firing sequence of its associated firearm is shown in U.S. Pat. No. 4,044,487 A. The dust cover is disposed inside the weapon housing, and has a control gate and is moved by a control bolt attached to the moving bolt. Depending on the position of the bolt, the dust cover opens and closes with a rotary motion, and thereby opens or closes the ejection port. This multi-part design requires a corresponding amount of increased effort in production and cannot be replaced quickly. Locating the dust cover inside the firearm housing also makes it easier for moisture and dirt to penetrate the action of the firearm, increasing the possibility of jamming, particularly given the rotating design of the dust cover.

The dust cover disclosed by U.S. Pat. No. 9,086,247 B2 is held to the firearm housing by a one-piece pin. The pin is inserted from below and fastened by means of a snap mechanism. When used under a strong load, the deflection of the pin can, in combination with the clearance necessary for the insertion of the pin, lead to unintentional unhooking of the pin, potentially including the loss of the pin itself as well as the dust cover. This can lead to jamming and/or premature wear, especially during longer field use.

U.S. Pat. Nos. 4,044,487; 7,181,881; 9,086,247; 9,612,075; 10,393,467; and US application publication no 2015/0285579 are each hereby incorporated by reference for any purpose.

There is therefore a need for an ejection port dust cover that performs advantageously well in its intended operation, i.e. that can be opened as easily and as trouble-free as possible when required, but that does not suffer the aforementioned disadvantages of existing dust covers. Such a dust cover should additionally be attached to the firearm housing in a loss-proof manner, in such a manner that it can be easily mounted or dismounted without tools. The dust cover should be floating in the housing when mounted, and its design should prevent unintentional disassembly/disintegration into individual parts when dismantled and thus prevent the loss of individual parts, especially in the field.

The present disclosure is directed to an optimized, reliable, loss-proof, and easy-to-install dust cover assemblies that advantageously satisfy the above requirements.

SUMMARY

The present disclosure is directed to improved dust cover assemblies that are reliable, loss-proof, and easy to install; and firearms equipped with the improved dust cover assemblies.

In one aspect, the disclosure includes dust cover assemblies for firearms, where the dust cover assemblies include a dust cover; a first bushing and a second bushing coupled to the dust cover in alignment with one another, the first bushing defining a first hole and the second bushing defining a second hole; a pin, received in at least the first bushing, the pin defining an axis of rotation and including a pin end, and a cover spring coiled around the pin between the first bushing and the second bushing; where the pin is spring-preloaded in a direction along the axis of rotation, and is movable between a mounting position, a disassembling position, and an end position; the pin includes a guide extension that extends from the pin in a radial direction; the first bushing defines a guide groove, so that the guide extension of the pin extends into the guide groove and the pin is thereby guided between the end position and the mounting position; the first bushing further defines an insertion groove on an inner surface of the first bushing, the insertion groove extending parallel to the axis of rotation of the pin, and beginning at an outer end of the first bushing and extending to and connecting with the guide groove, such that the insertion groove accommodates the guide extension of the pin when the pin is received by the first bushing.

In one aspect, the disclosure includes firearms, where the firearms include a firearm housing defining an ejection port; and a dust cover assembly that includes a dust cover having at least one sealing lip that is substantially complementary in shape to the ejection port; a first bushing and a second bushing coupled to the dust cover in alignment with one another, the first bushing defining a first hole and the second bushing defining a second hole; a pin, received in at least the first bushing, the pin defining an axis of rotation and including a pin end; a cover extension formed on a second end of the second bushing; and a cover spring coiled around the pin between the first bushing and the second bushing; where the pin is spring-preloaded in a direction along the axis of rotation, and is movable between a mounting position, a disassembling position, and an end position; the pin includes a guide extension that extends from the pin in a radial direction; the first bushing defines a guide groove, so that the guide extension of the pin extends into the guide groove and the pin is thereby guided between the end position and the mounting position; the first bushing further defines an insertion groove on an inner surface of the first bushing, the insertion groove extending parallel to the axis of rotation of the pin, and beginning at an outer end of the first bushing and extending to and connecting with the guide groove, such that the insertion groove accommodates the guide extension of the pin when the pin is received by the first bushing; and where the pin end is received by a first bearing in the firearm housing, and the cover extension is received by a second bearing in the firearm housing.

The disclosed features, functions, and advantages of the disclosed dust cover assemblies and firearms may be achieved independently in various embodiments of the present disclosure, or may be combined in yet other embodiments, further details of which can be seen with reference to the following description and drawings.

DETAILED DESCRIPTION

Figure 1:
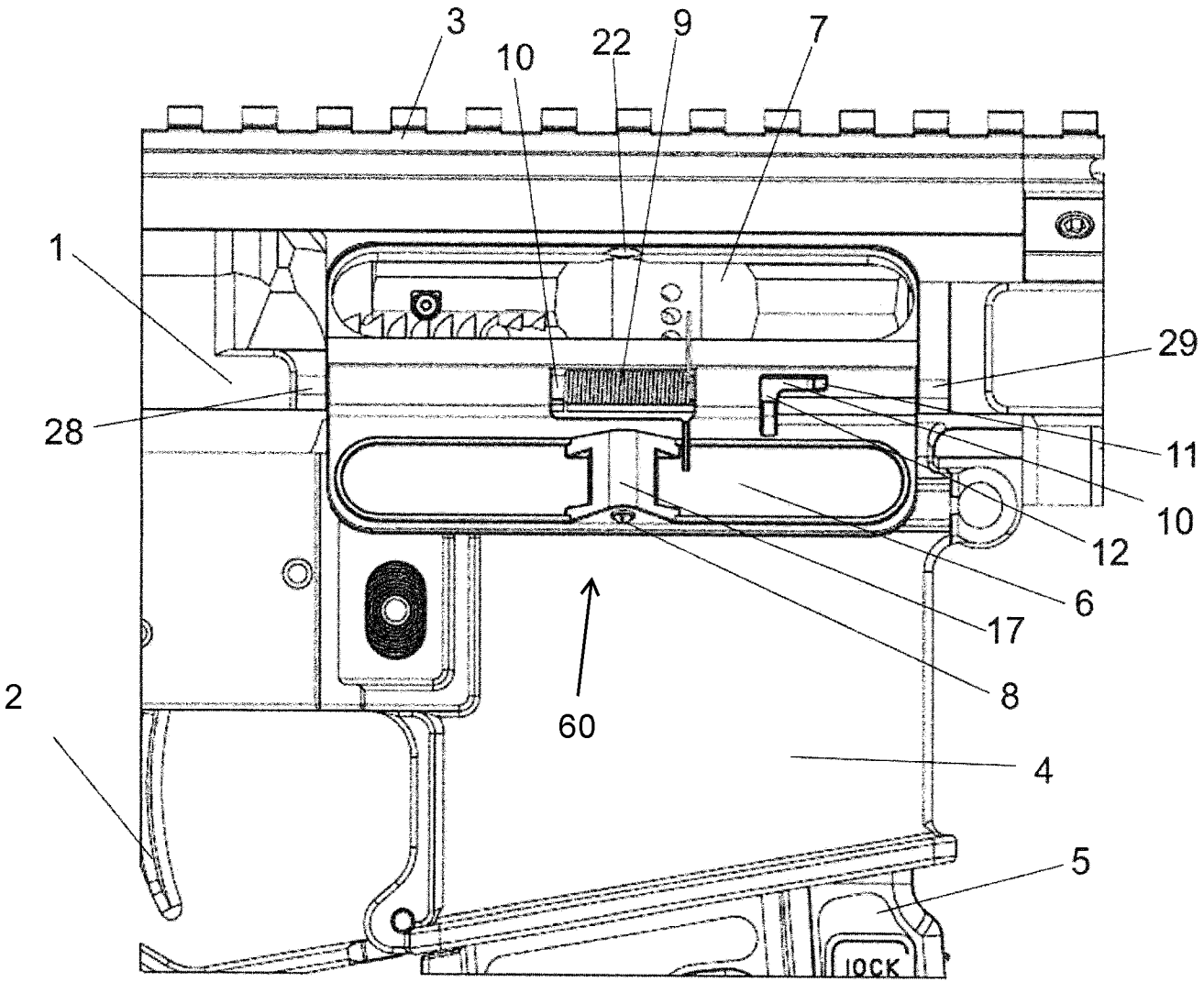
FIG. 1 shows an exemplary dust cover assembly according to the present disclosure disposed on a representative firearm housing in its open state.

Although the ejection port dust cover assemblies of the present disclosure are primarily disclosed in the context of rifles, the term "firearm" as used herein encompasses any firearm possessing an ejection port that may benefit from being equipped with an improved dust cover assembly.

The terms "left," "right," "front," "back," "top," "bottom" and so on are used herein within the context of firearms and common sense, i.e. the muzzle of a rifle is "front," the magazine protrudes "down," and the breech and/or slide is moved to the "rear" by expanding gases. Crosswise to a direction means substantially a direction turned by 90° to it. The center plane of a firearm is defined as a vertical plane that intersects the barrel axis of the firearm.

Although ejection port dust cover assemblies are typically associated with and coupled to an existing firearm, dust covers are also available as independently traded parts (for example, after-market parts), that can be manufactured and sold for the replacement of existing dust covers. The present disclosure relates to the improved dust cover assemblies described herein whether they are considered individually, or considered as a component of an existing firearm.

The dust cover assemblies of the present disclosure are a modification of known dust covers of long guns, in particular of fully and/or semi-automatic gas-operated loaders such as type M4/M16/AR15. However, the presently disclosed dust cover assemblies confer significant advantages onto the firearms with which they may be associated.

As set out in the present disclosure, the disclosed dust cover assemblies have, on the spring-biased prestressed pin, a guide extension which interacts with a guide groove and an insertion groove formed parallel to the axis of rotation of the pin, which groove lies within a first bushing and extends from the outer end of the bushing to the guide groove and is connected to the guide groove.

This configuration enables the disclosed dust protection cover to be mounted on a firearm housing in a way that protects against loss of the dust cover, and permits the pin to be mounted in a loss-proof manner. It is also possible to mount the dust cover easily to a firearm housing easily and without additional tools. The dust cover assemblies also have the advantage of requiring low manufacturing costs. In addition, the risk of deflection of the pin during mounting or dismounting of the dust cover is minimized. This not only has a positive effect on the service life of the pin, but also reduces additional friction when opening or closing the dust cover and thus reduces the risk of jamming.

It should be appreciated that many designs are possible that include the configuration where the pin is only mounted inside the first bushing and/or prestressed by a spring.

In a further aspect of the disclosed dust cover assemblies, the guide groove formed in the first bushing has two substantially L-shaped legs, one leg being parallel to the axis of rotation of the pin and a second leg being formed in the direction of rotation.

Furthermore, it may be useful for the pin to be partially received in the second bushing and axially biased towards the first end by a spring.

It may be particularly advantageous for the guide extension of the dust cover assembly to urge the pin against an end stop of the guide groove, thus limiting the axial movement of the pin in the first bushing.

The presently disclosed dust cover assemblies may also include a guide groove defining a mounting latch that allows the pin guide extension to be temporarily locked in the mounting position, i.e. with the pin end fully retracted into the first bushing.

It may be additionally advantageous to provide a dust cover assembly having a guide extension that is fixed to or detachable from the pin, or that is integrally formed with the pin.

Alternatively, or in addition, it can be advantageous that a cover extension is formed on the second bushing to be accommodated in a second bearing of the housing.

In a particular embodiment, the second bushing of the disclosed dust cover assembly has a second internal hole with diameter D2, whereby the second hole can have a tapered diameter D3 at the second end, or the second hole can be formed as a blind hole.

It may also be useful to arrange a pin spring in the second bushing of the dust cover assembly.

In addition, it can be advantageous that an end pin is arranged in the second bushing.

It has proved to be particularly advantageous for the dust cover assembly to have sealing lips, which are substantially complementary in shape to the ejection port of the firearm, and enable the dust cover to be closed more effectively and without gaps, as well as causing the dust cover to be centered in the bearing in the housing.

It may further be provided that the dust cover includes and defines a cover bay, which is complementary in shape to an arm of a cover spring, so as to engage with that arm and transfer the spring force to the dust cover.

The defined force for biasing, or prestressing, the pin via a spring is transmitted to the dust cover by the end stop of the guide groove and is not transmitted axially to a bearing. This design allows the dust cover to float in the housing and thus ensures that the ejection port can be opened as easily and trouble-free as possible, if necessary. The bearings in the housing, on the other hand, can be realized e.g. by short bores, no complex bearings to be manufactured are necessary.

Another aspect of the invention concerns the design of the guide groove. One leg of the guide groove may be substantially parallel to the pin axis, with a second leg extended in the direction of rotation of the pin axis. A mounting latch may be provided for easier mounting, and the reversible locking of the guide extension in the mounting latch leads places the pin in the mounting position in which the pin end is completely retracted into the first bushing and thus allows easy mounting and dismounting of the dust cover on the housing. In this mounting position, the dust cover is protected against unintentional dismounting/disintegration into its individual parts and thus against possible loss of individual parts. This may be particularly advantageous in the field.

An end pin may be arranged in the second bushing, possibly made of a more rigid material than the dust cover, thereby enabling the cover extension to be stiffened and the spring force to be better dissipated into the dust cover, without excessive material stress, especially with designs and combinations of a metal spring and a plastic dust cover.

The axial prestressing of the pin is preferably achieved by means of a pin spring arranged in the second bushing.

It is clear to the person skilled in the art that symmetrical embodiments of the disclosed dust cover assemblies are possible without any problems and that they can be gleaned both from the description of the figures and from the claims.

FIGS. 1 to 6 primarily show exemplary embodiments of the invention that are suitable for use in an AR15- or M4-type rifle. A person having ordinary skills in the art with the benefit of the present disclosure could readily modify the embodiments disclosed herein to other types of rifles and firearms without extensive or complex testing. Any other combinations of the technical features of the individual figures depicted and their different forms of expression are also easily possible for the person skilled in the art with knowledge of the invention.

FIG. 1 shows a dust cover assembly 60, including a dust cover 6, in the installed and open state, folded downwards. The dust cover assembly 60 includes the dust cover 6 itself, but further includes the bushings, pins, springs, and other components disclosed herein that advantageously mount dust cover 6 to an ejection port of a firearm.

As shown in FIG. 1, the dust cover 6 is mounted on a first bearing 28 and a second bearing 29 of a frame or housing 1 of a weapon (firearm) and is located in the example shown in the area between trigger 2, magazine well 4 including magazine 5 as well as the upper end of housing 1, in the illustrated exemplary embodiment with a mounting rail 3. Further visible is a cover spring 9 which prestresses the dust cover so that it can fold down from the closed position around the axis of pin 10 into the open position when opening. The first bearing 28 and the second bearing 29 are located on/in the housing according to the axis of the pin 10. The open dust cover 6 opens the ejection port 7; part of the bolt can be seen behind it.

If the dust cover 6 is closed, a cover projection 17 protrudes into the movement path of the bolt. When a shot is fired, the high energy suddenly released drives the projectile forward out of the muzzle, but at the same time some of the energy is directed towards the bolt, causing the bolt to move backward. The backward sliding bolt then touches the cover projection 17 and pushes it outwards with sufficient force so that the spring-mounted thrust piece 8, which is located in a latch 22 of the cover projection 17, yields and is pushed out of the latch 22. The dust cover 6, which is prestressed by the cover spring 9, folds down correspondingly into the open position and opens the way for the cartridge case to be ejected, which is possible without obstacles. The dust cover 6 subsequently remains open as a result of the spring force of the cover spring 9 and is closed again only by e.g. manual intervention.

The dust cover 6 can be easily removed from the housing 1 by moving the pin 10 on a guide extension 11 along a guide groove 12 in axial direction, parallel to the running axis, towards the center of the dust cover 6. This movement causes the pin end 13 engaging in the first bearing 28 to be pulled out of it and the dust cover 6 can be removed. A more detailed explanation of the function of pin 10 with guide extension 11 and guide groove 12 is given below.

Figure 2:
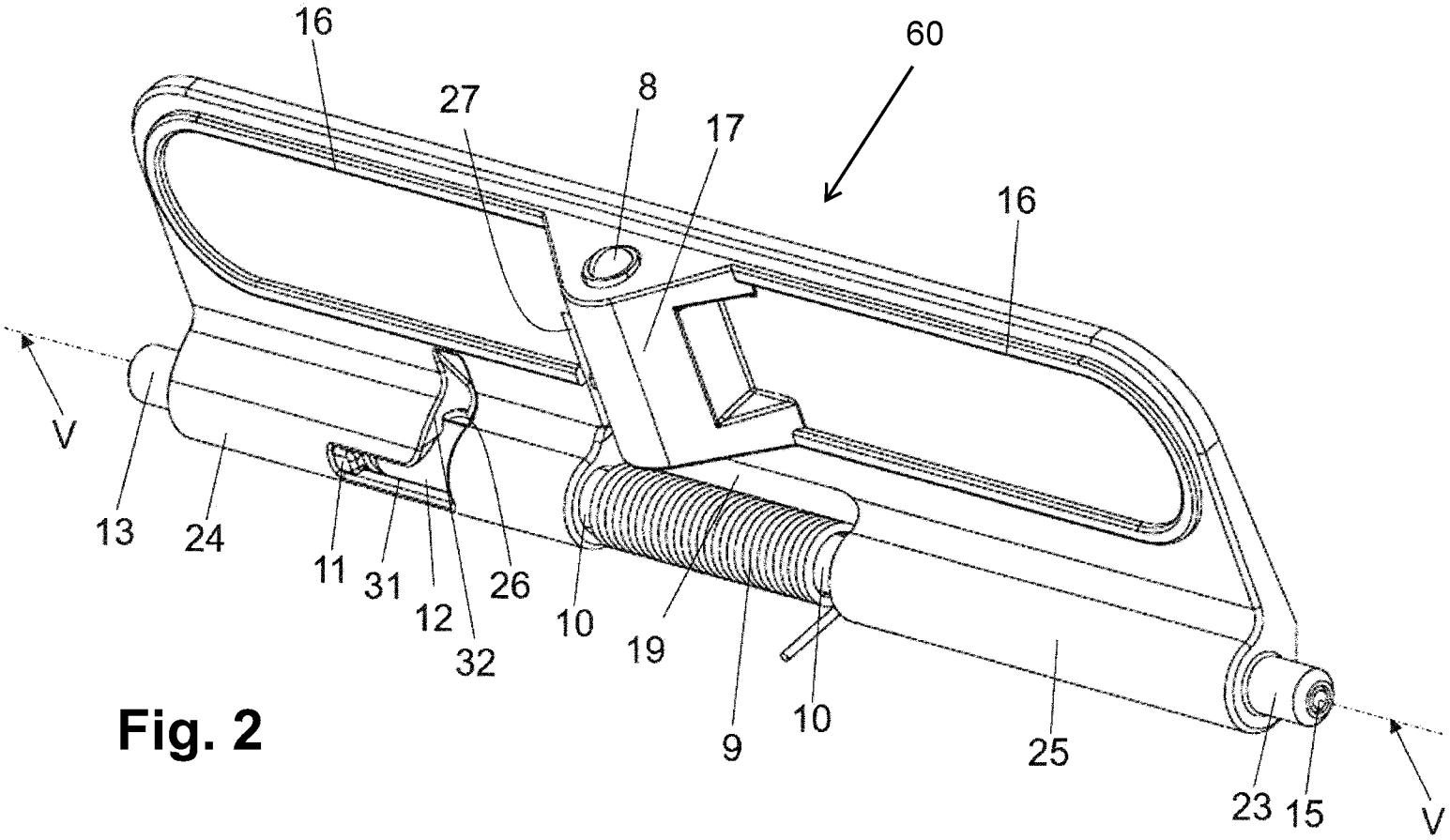
FIG. 2 shows the exemplary dust cover assembly of FIG. 1 in a perspective view.
Figure 3:
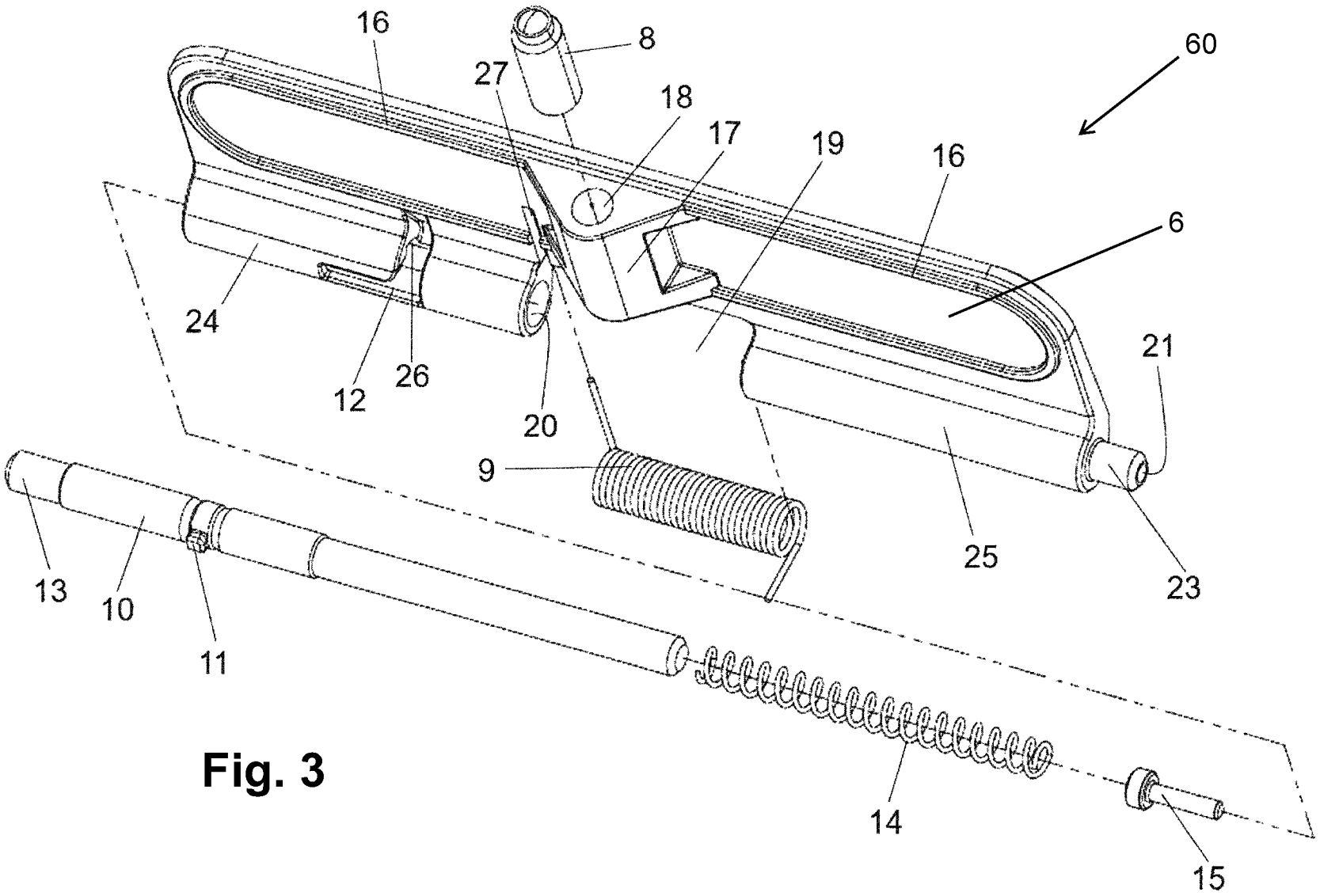
FIG. 3 shows the exemplary dust cover assembly of FIG. 2 in an exploded view.
Figure 4:
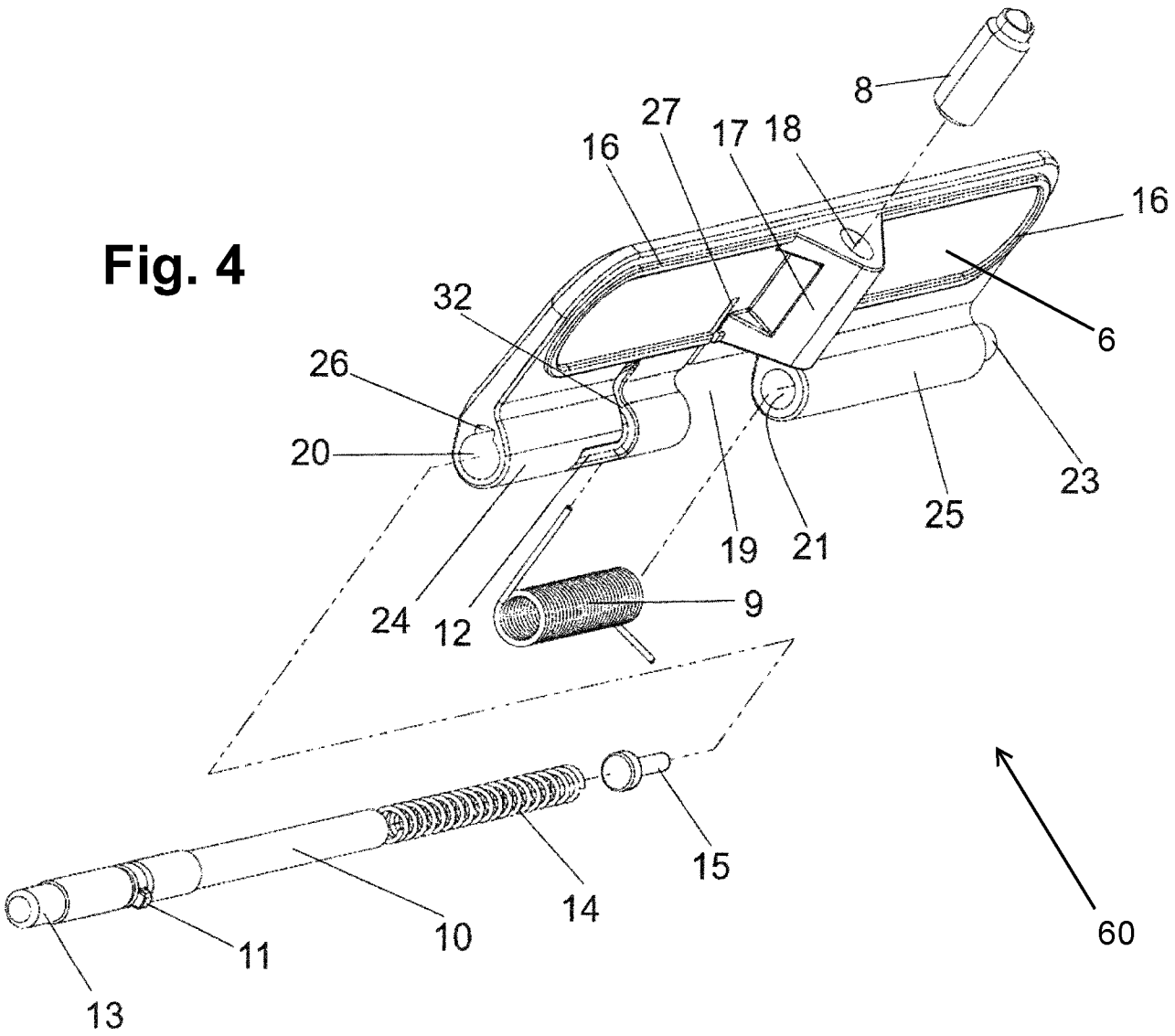
FIG. 4 shows the exemplary dust cover assembly of FIG. 3 from another perspective.

FIG. 2 shows an embodiment of the dust cover assembly 60 according to the invention in the mounted state but not mounted on the housing 1 and is discussed together with FIGS. 3 and 4, which show the dust cover assembly 60 in exploded view from different directions. The dotted line represents the axis of the pin 10 of FIG. 2; and with the direction of the arrows this defines the cutting plane V-V illustrated by FIGS. 5A and 5B. The dust cover itself is largely flat and elongated and, as shown, preferably has at least one sealing lip 16 and a protruding cover projection 17. The sealing lip 16 causes an improved and gap-free closing of the ejection port 7, whereby the penetration of dust, dirt and moisture into the interior of the firearm is substantially reduced. Due to the interaction of the sealing lip 16, which is largely complementary in shape to the ejection port 7, the dust cover 6 is also axially centered in the bearings 28 and 29 in the closed state, whereby an easier and reduced friction opening of the dust cover 6 is possible. Furthermore, the sealing lip 16 can cause increased friction around the ejection port 7 of housing 1, which reduces the risk of the closed cover from moving relative to housing 1 and thus reduces the risk of possible rattling.

As a closing mechanism for the embodiment shown, a spring-loaded thrust piece 8 is fastened to the cover projection 17 in a corresponding thrust piece bore 18 (FIG. 3). A ball of the spring-loaded thrust piece lies spring-loaded in the latch 22 of the housing when closed and reduces the risk of unintentional opening of the dust cover 6.

A first bushing 24 and a second bushing 25 are formed along one longitudinal side of the dust cover 6. The outer end of the first bushing 24 in the longitudinal direction is subsequently referred to as the first end. The other outer end of the second bushing 25 in the longitudinal direction is subsequently referred to as the second end. The second bushing 25 can be designed as a "solid body", whereby the bearing and, in a further variant, also the spring preload of pin 10 takes place within the first bushing 24.

The second bushing 25 has a substantially cylindrical cover extension 23 at the second end. Depending on the material and design of the dust cover 6, the first and/or second bushing 24, 25 may be of different design, but they must be seen as a joint rotatable about a common axis. Possible designs are, for example, strips of sheet metal bent or rolled into cylindrical rolls, or, if they are for example made of solid material or by injection molding, elongated, thickened areas with cylindrical and internal holes/bores. In the first bushing 24, the hole formed is called the first hole 20, in the second bushing 25 the second hole 21 is formed.

Figure 5B:
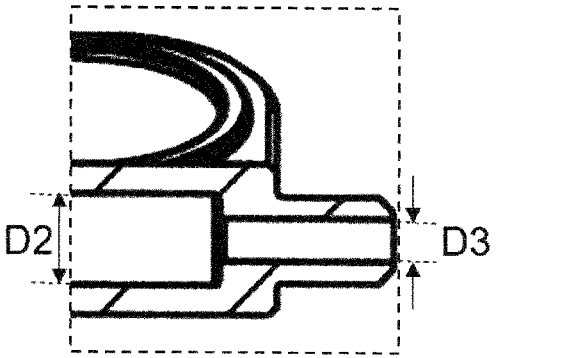
FIG. 5B shows a detail of FIG. 5A, as indicated.
Figure 5A:
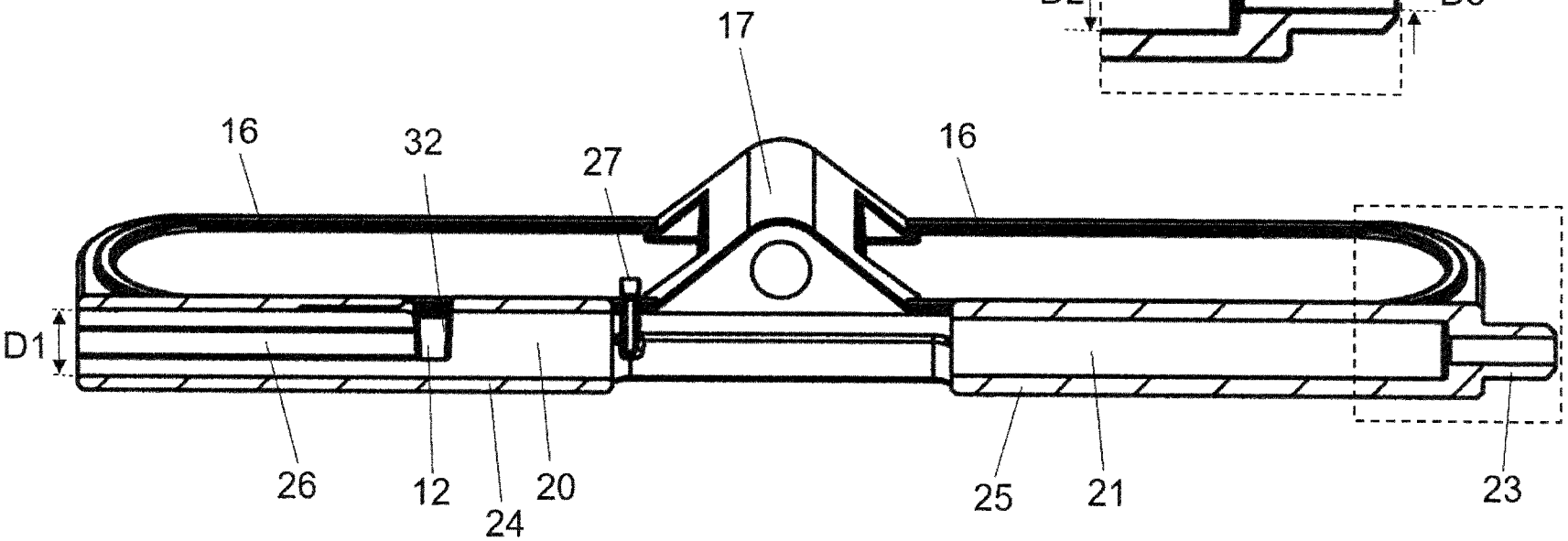
FIG. 5A shows a cross-section view of the exemplary dust cover assembly of FIG. 1 through the bushings of the dust cover.

The first hole 20 has at least one diameter D1 (see also FIG. 5A). The second hole 21 has a diameter D2, which is either the same size as or smaller than D1 (D2≤D1), but at the second (outer) end it may have a tapered diameter D3 after a stepped or smooth transition (FIG. 5B). The second hole 21 can also be designed as a blind hole and only partially protrude into the second bushing 25, but in a preferred and shown embodiment the second hole 21 is designed over the full length of the second bushing 25 with cover extension 23, especially preferably with the already described taper of the diameter at the outer end.

As shown in FIGS. 2 and 4 in particular, the first bushing 24 has an insertion groove 26 on its inside and aligned parallel to its axis, which extends from the first end to a guide groove 12 and merges into it. The guide groove 12 in the embodiment shown is L-shaped, with a first leg 31 aligned substantially parallel to the axis of the pin 10 and standing approximately normal to a second leg 32. The guide groove 12 completely penetrates the first bushing 24 in the radial direction up to the first hole 20 and thus forms a radial breakthrough of the first bushing 24.

In addition to the substantially L-shaped design of the guide groove 12 shown in FIGS. 2-4, other variants are also possible. Further exemplary embodiments are described below and shown purely schematically in FIGS. 6A and 6B. The length of the first leg 31 is in the range from 1/10 to 3/4 of the length of the first bushing 24, preferably in the range from 1/5 to 1/2.

Between the first and second bushings 24 and 25 there is a spring recess 19. The cover spring 9 is preferably designed as a leg or torsion spring with two arms. The spiral of the cover spring 9 can be coiled around and/or penetrated by pin 10 when assembled, as shown, in order to support the cover spring 9 in the axial direction of pin 10. Pin 10 can protrude up to or partially into the second bushing 25 for support. When assembled, one arm of the cover spring 9 is received by, and lies within, the spring bay 27, the second arm lies against the housing 1; the spring forces the dust cover 6 into the OPEN position (FIG. 1).

When dust cover assembly 60 is fully assembled, pin 10 lies in the first bushing 24, penetrates (it protrudes from the spring on both sides) the spring recess 19 and the spiral of the cover spring 9 and partly protrudes into the second bushing 25. Pin end 13 protrudes from the first bushing 24 at the first end and, as shown, can protrude into the first bearing 28 in housing 1.

A guide extension 11 can be firmly or detachably connected to pin 10 or integrally formed on pin 10. The guide extension 11 lies in the guide groove 12 and is pressed with the pin 10 by the pretension of a spring member against the end stop 33 of the guide groove 12 and thus limits the possible movement of the pin 10 in the direction of the pin end 13. Through the end stop 33, the defined force of the spring preload remains within the dust cover assembly 60 and is not transmitted to other components, in particular to the first and second bearings 28 and 29.

The pin 10 can be pushed against the spring preload in the direction of the second end by applying a slight force to the guide extension 11 in the direction of the second end, e.g. by pulling or pressing with a finger. This allows the pin end 13 to be completely retracted into the first bushing 24; this position is referred to as the mounting position below. The position in the assembled state of pin 10 with the guide extension 11 abutting against the end stop 33 is referred to as the end position.

In the embodiment shown, the spring preload of the pin is generated by a pin spring 14 arranged in the second bushing 25 and designed as a spiral spring, but other variants are also possible. For example, the pin spring can be arranged partially or completely in the spring recess 19. There are also possible variants with pin spring 14 arranged in the first bushing 24, whereby in such embodiments both the first bushing 24 and the pin 10 have a corresponding taper. However, variants without a separate pin spring 14 are also possible, e.g. this spring preload can be provided by a correspondingly shaped cover spring, which simultaneously acts as torsion spring and axial spring.

In one preferred and exemplary embodiment as shown, the dust cover assembly 60 may include an end pin 15 which, when mounted, lies in the second end of the second bushing 25 and which is complementary in shape to the tapered end with diameters D2 and D3 of the second hole 21. In one preferred embodiment, the end pin 15 may be made of a harder and/or more rigid material than dust cover 6 in order to obtain additional stability against the pin spring 14 and/or the cover extension 23 and/or the second bearing 29. Material combinations include, for example, plastic, metal, ceramic or composite materials. Embodiments with a fixed end pin 15 are possible, e.g. glued in place or injection-molded in the manner of a lost core, or with a loose and removable end pin 15. However, embodiments without end pin 15 are also possible.

In one preferred embodiment, the dust cover assembly 60 may include a pin spring 14, which may be located, for example, between the end pin 15 and the part of the pin 10 projecting into the second bushing 25. The pin spring can be fixed to the pin 10 and/or the end pin 15, or it can be loose. The pin spring 14 may be partially arranged around a tapered part of pin 10 and/or end pin 15. In the preferred embodiment shown, the end pin 15 is pressed in the direction of the second end by the spring force of the pin spring 14.

The dust cover assembly of the present disclosure can be assembled with ease, and the assembly may be performed without tools. First, the end pin 15 and then the pin spring 14 are inserted from the spring recess 19 into the second bushing 25. Then the cover spring 9 is brought into its position in the spring recess 19 and the pin 10 is pushed from the first end towards the second end through the first bushing 24, whereby the guide extension 11 is guided by the insertion groove 26. The pin 10 is pushed in the direction of the second end until the guide extension 11 reaches the end of the insertion groove 26 and thus the guide groove 12. Now the pin 10 is rotated about its own axis along the second leg 32 of the guide groove 12 until the guide extension 11 reaches the first leg 31 of the guide groove 12. The pin 10 is now moved axially with the guide extension 11 in the direction of the first end. Guide groove 12 limits the axial movement of pin 10 in first bushing 24 by a contact of guide extension 11 against end stop 33 of the first leg of the guide groove, the end stop being formed closer to an outer first end of the first bushing than to the second leg of the guide groove. Pin movement therefore ends when the guide extension 11 hits the end stop 33 of the guide groove 12. The pin 10 then penetrates the spring recess 19 together with the cover spring 9 and rests partly in the second bushing 25 when the guide extension 11 has reached the end stop 33 and thus the end position.

In the end position, the guide extension 11 is located in the first leg 31 of the guide groove 12. By applying a slight force in the direction of the second end, e.g. by pulling or pressing with a finger on the guide extension 11, the pin 10 can be pushed against the spring preload, in the example shown, against the spring force of the pin spring 14, in the axial direction towards the second end. This allows the pin end 13 to be retracted into the first bushing 24 and thus brought into the mounting position. This makes it easy to remove the dust cover 6 without the need for complete disassembly of dust cover assembly 60.

If it is necessary to completely disassemble the disclosed dust cover assembly 60, this can be done just as easily and without tools. The pin 10 is first brought into the assembly position by pulling or pressing on the guide extension 11, then the guide extension 11 is moved further along the guide groove 12 in the direction of the insertion groove 26 through rotation. As soon as the guide extension 11 reaches the insertion groove 26 and thus the disassembly position, the spring preload causes the pin 10 to move axially towards the first end. The pin 10 can be removed and the dust cover assembly 60 completely disassembled.

Accordingly, the dust cover assembly 60, according to the present disclosure, permits the dust cover 6 to be very easily and simply mounted or dismounted on a firearm housing without the aid of tools. First, the mounting position is reached by pressing or pulling the guide extension 11 towards the second end. Then, the cover extension 23 is positioned in the second bearing 29 of the housing 1 and the first bushing 24 is aligned next to the first bearing 28. Now, the pressure or pull on the guide extension 11 can be terminated and the mounting position can be terminated, the pin 10 moves automatically into the end position. The pin end 13 moves out of the first bushing 24 into the first bearing 28 and the dust cover 6 according to the invention is thus mounted on the housing in a manner that reduces the risk of loss. Removing the dust cover 6 is just as easy with the opposite sequence as described above.

In the end position, the pin end 13 does not exert an outward axial force on the bearing 28 in the axial direction due to the stop of guide extension 11 at end stop 33, as this is deep enough. For the same reason, the cover extension 23 does not exert an outward axial force on the bearing 29 either, which is why it can be said that the dust cover 6 is floating. This bearing arrangement is gentle on the material in terms of wear and tear and facilitates particularly easy opening of dust cover 6 without jamming. This bearing arrangement and the mechanism described also make it possible to install and remove the dust cover particularly easily, even in the field and in adverse weather conditions.

The cover assembly of the disclosed invention represents a design which prevents the pin 10 from deflecting, e.g. when mounted on housing 1. The spring preload of pin 10 represents both loss protection for dust cover 6 mounted on housing 1 and loss protection for pin 10 of dust cover assembly 60 when dismounting it from the housing.

FIGS. 5A and 5B show a cross-section of dust cover assembly 60 on the first and second bushings 24 and 25 along the axis of pin 10. For better clarity, pin 10, pin spring 14 and end pin 15 are not shown. Clearly visible is the insertion groove 26, which is formed on the inside of the first bushing 24 parallel to the axis of pin 10. It begins at the first end of the first bushing 24 and extends to the second leg 32 of the guide groove 12, which is formed in the circumferential direction with respect to the pin axis. Together with the guide groove 12, it forms a substantially U-shaped groove system, in which the guide extension 11 is held and mounted. The diameter D2 of the second hole 21 and the tapered diameter D3 at the outer end of the second bushing 25 and at the cover extension 23 are particularly clearly visible. The diameter D1 of the first hole 20 is also clearly visible and is either the same size as D2 or larger than D2.

Figure 6A:
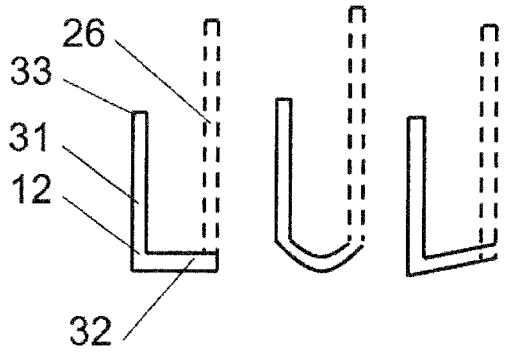
FIGS. 6A and 6B show selected illustrative embodiments of a guide groove for the dust cover assemblies of the present disclosure.
Figure 6B:
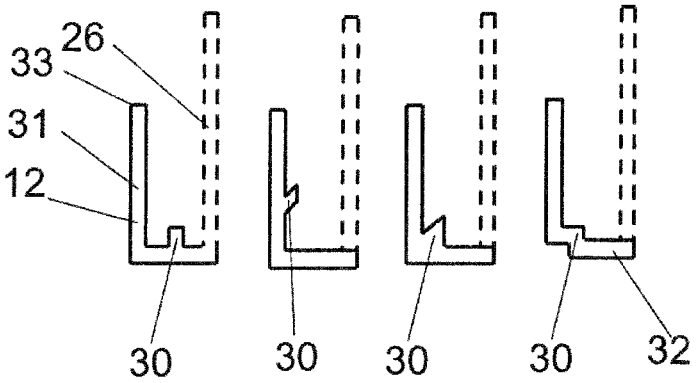

According to the present disclosure, other embodiments than the previously described L-shape of the guide groove 12 are also possible. FIGS. 6A and 6B show examples of such possible deviating variants; the insertion groove 26 is indicated in dashed lines, the substantially formed U-shape is clearly visible. FIG. 6A shows the L-shaped embodiment with end stop 33, first leg 31 and second leg 32, a version with a rounded second leg 32 and a version with an acute angle between the first and second legs 31 and 32. Further variants are also conceivable, e.g. with a V-shaped second leg 32. FIG. 6B shows possible exemplary variants of the guide groove 12, which may be configured to include at least one additional mounting latch 30. This mounting latch 30 allows the guide extension 11 to be engaged in the mounting position for easier assembly or disassembly of dust cover assembly 60, with the mounting latch 30 positioned so that pin end 13 is fully retracted into bushing 24. The pin 10 is secured so as to reduce the risk of loss in the mounting position, and the risk of unintentional removal of the pin 10 from the dust cover 6 is reduced.

For example, a mounting latch 30 can be attached to the part of the guide groove parallel to the axis of the pin 10, i.e. to the first leg 31 as a branch, e.g. in Y-shape or T-shape. The mounting latch can also be formed on the second leg 32 of the guide groove, for example as a T-shaped branch, but other latch-forming designs of the second leg 32 are also possible, as shown for example in FIG. 6B, as a W-shape or in the shape of an inverted U or V. Other latch-forming designs shown are steps and serrations.

The dust cover assembly 60, as disclosed herein, can be made of all materials used in the prior art for such covers, for example largely plastic or metal. Of course, different combinations of plastic, metal, ceramic or even composite material are also possible. Knowing the invention, it is easy for the person skilled in the art to make a suitable selection here.

The production of the presently disclosed dust cover assembly can, for example, take place by means of machining processes such as milling, turning or grinding; the dust cover assembly 60 can also be formed by means of one or more shaping processes such as injection molding, extrusion or MIM, or also by means of additive manufacturing processes such as 3D printing or a combination of these or other processes.

Selected additional aspects and features of the disclosed dust cover are presented below without limitation as a series of paragraphs, some or all of which may be alphanumerically designated for clarity and efficiency. Each of these paragraphs can be combined with one or more other paragraphs, and/or with disclosure from elsewhere in this application, in any suitable manner.

Some of the paragraphs below expressly refer to and further limit other paragraphs, providing without limitation examples of some of the suitable combinations.

A1. Dust cover for an existing firearm, comprising a first bushing (24) and a second bushing (25), a pin (10) guided in the first bushing (24) with pin end (13) and a cover spring (9), characterized in that the pin (10) is received spring-preloaded in the axial direction at least in the first bushing (24) and movable between a mounting position, a disassembling position and an end position, and a guide extension (11) for interacting with a guide groove (12) of the first bushing (24) thereby guiding the guide extension (11) between the end position and the mounting position, and an insertion groove (26) of the first bushing (24) for inserting the pin (10) from the disassembling position to the mounting position is formed on the pin (10), in that furthermore the insertion groove (26) is formed parallel to the axis of rotation of the pin (10) on the inside of the first bushing (24), begins at the outer end of the bushing (24) and ends at the guide groove (12) and is connected to the guide groove (12).

A2. Dust cover according to paragraph A1, characterized in that the guide groove (12) is substantially L-shaped with two legs, a first leg (31) of the guide groove (12) is formed parallel to the axis of rotation of the pin (10) and a second leg (32) is formed in the direction perpendicular to the first leg, in a plane perpendicular to the axis of rotation.

A3. Dust cover according to paragraph A2, characterized in that the first leg (31) has a length in the axial direction of the pin (10) in the range from 1/10 to 3/4 of the length of the first bushing (24), preferably from 1/5 to 1/2.

A4. Dust cover according to any of the preceding paragraphs, characterized in that the pin (10) is partially received in the second bushing (25).

A5. Dust cover according to any of the preceding paragraphs, characterized in that a pin spring (14) for applying the prestressing force to the pin (10) is arranged in the axial direction inside the second bushing (25).

A6. Dust cover according to any of paragraphs A2 to A5, characterized in that the guide groove (12) limits the axial movement of the pin (10) in the first bushing (24) by hitting the guide extension (11) against an end stop (33) of the first leg (31) of the guide groove (12), the end stop (33) being formed closer to the first end than the second leg (32).

A7. Dust cover according to any of the preceding paragraphs, characterized in that the guide groove (12) has at least one mounting latch (30) for temporarily locking the guide extension (11) of the pin (10) in a mounting position.

A8. Dust cover according to any of the preceding paragraphs, characterized in that the guide extension 11 is connected firmly or detachably to the pin (10).

A9. Dust cover according to any of the preceding paragraphs, characterized in that the guide extension (11) is formed integrally at pin (10).

A10. Dust cover according to any of the preceding paragraphs, characterized in that a cover extension (23) is formed on the second bushing (25) at a second end for reception into a second bearing (29) of the housing (1).

A11. Dust cover according to any of the preceding paragraphs, characterized in that the second bushing (25) has a second hole (21) with a second diameter D2.

A12. Dust protection cover according to paragraph A11, characterized in that the second hole (21) has a diameter D3, which is smaller than D2, in the axial direction in the direction of the cover extension (23).

A13. Dust protection cover according to one of paragraphs A11 or A12, characterized in that the second hole (21) is formed as a blind hole.

A14. Dust cover according to any of the preceding paragraphs, characterized in that an end pin (15) is arranged in the second end of the second bushing (25) directly connected to a pin spring (14).

A15. Dust cover according to any of the preceding paragraphs, characterized in that at least one sealing lip 16 is formed on the dust cover (6), which sealing lip is substantially complementary in shape to an ejection port (7) of a housing (1).

A16. Dust cover according to any of the preceding paragraphs, characterized in that the dust cover (6) has a spring bay (27) which is complementary in shape to an arm of a cover spring (9).

The disclosure is not limited to the specific embodiments detailed herein or shown in the figures, but also includes other variants, particularly with regard to the shapes and position of the insertion groove and guide groove or the number and design of the bushings and the holes formed therein and the corresponding design of pins and end pins complementary in shape.

As used herein, indications such as "lower area" of an object mean the lower half and in particular the lower quarter of the total height, "lowest area" the lowest quarter and in particular an even smaller part, while "center area" means the center third of the total height. This applies mutatis mutandis to the terms "width" or "length". All these indications have their common meaning, applied to the intended position of the object under consideration.

In the description and the claims "substantially" means a deviation of up to 10% of the indicated value, if it is physically possible, both downward and upward, otherwise only in the meaningful direction, for degrees (angle and temperature) this means±10°. If terms such as "substantially constant" etc. are used, this refers to the technical and not the mathematical possibility of deviation, which the person skilled in the art uses as a basis. A "substantially L-shaped cross-section", for example, comprises two elongated surfaces, each of which merges at one end into the end of the other surface and whose longitudinal extension is arranged at an angle of 45° to 120° relative to one other.

All quantities and percentages, in particular those used to delimit the invention, unless they do concern the concrete examples, are to be understood with a tolerance of ±10%, i.e. 11% means, for example, from 9.9% to 12.1%. In the case of terms such as "a solvent", the word "a" is not to be regarded as a numerical word, but as an indefinite article or a pronoun, unless the context indicates otherwise.

The term "combination" or "combinations" means, unless otherwise indicated, all types of combinations from two of the ingredients concerned to a multitude or all of such ingredients, the term "containing" also means "comprising".

The features and variants indicated in the individual embodiments and examples may be freely combined with those of the other examples and embodiments and, in particular, used to identify the invention in the claims without necessarily taking along the other details of the respective embodiment or example.

Although the present ejection port dust cover has been shown and described with reference to the foregoing operational principles and preferred embodiments, it will be apparent to those skilled in the art that various changes in form and detail may be made without departing from the spirit and scope of the present disclosure. The present invention is intended to embrace all such alternatives, modifications and variances that fall within the scope of the appended claims.

| Listing of Reference Numerals | |
|---|---|
| 1 | Housing |
| 2 | Trigger |
| 3 | Mounting rail |
| 4 | Magazine well |
| 5 | Magazine |
| 6 | Dust cover |
| 7 | Ejection port |
| 8 | Spring-loaded thrust piece |
| 9 | Cover spring |
| 10 | Pin |
| 11 | Guide extension |
| 12 | Guide groove |
| 13 | Pin end |
| 14 | Pin spring |
| 15 | End pin |
| 16 | Sealing lip |
| 17 | Cover projection |
| 18 | Thrust piece bore |
| 19 | Spring recess |
| 20 | First hollow cylinder |
| 21 | Second hollow cylinder |
| 22 | Bolt |
| 23 | Cover extension |
| 24 | First bushing |
| 25 | Second bushing |
| 26 | Insertion groove |
| 27 | Spring bay |
| 28 | First bearing |
| 29 | Second bearing |
| 30 | Mounting latch |
| 31 | First leg |
| 32 | Second leg |
| 33 | End stop |
| 60 | Dust Cover Assembly |

What is claimed is:

1. A dust cover assembly for a firearm, comprising:

a dust cover;

a first bushing and a second bushing coupled to the dust cover in alignment with one another, the first bushing defining a first hole and the second bushing defining a second hole;

a pin, received in at least the first bushing, the pin defining an axis of rotation and including a pin end, and a cover spring coiled around the pin between the first bushing and the second bushing;

wherein the pin is spring-preloaded in a direction along the axis of rotation, and is movable between a mounting position, a disassembling position, and an end position;

the pin includes a guide extension that extends from the pin in a radial direction;

the first bushing defines a guide groove, so that the guide extension of the pin extends into the guide groove and the pin is thereby guided between the end position and the mounting position; and the first bushing further defines an insertion groove on an inner surface of the first bushing, the insertion groove extending parallel to the axis of rotation of the pin, and beginning at an outer end of the first bushing and extending to and connecting with the guide groove, such that the insertion groove accommodates the guide extension of the pin when the pin is received by the first bushing.

2. The dust cover assembly of claim 1, wherein the guide groove is substantially L-shaped with two legs, a first leg of the guide groove being formed parallel to the axis of rotation of the pin and a second leg of the guide groove being formed in the direction perpendicular to the first leg, in a plane perpendicular to the axis of rotation.

3. The dust cover assembly according to claim 1, wherein the pin is at least partially received in the second bushing.

4. The dust cover assembly of claim 1, wherein the pin is spring-preloaded in the direction along the axis of rotation by a pin spring arranged in an axial direction inside the second bushing.

5. The dust cover assembly of claim 1, wherein the guide extension is connected firmly or detachably to the pin.

6. The dust cover assembly of claim 1, wherein the guide extension is formed integrally with the pin.

7. The dust cover assembly claim 1, wherein the first hole of the first bushing has a first diameter D1, and the second hole of the second bushing has a second diameter D2.

8. The dust cover assembly of claim 1, further comprising a cover extension formed on the second bushing at a second end, wherein the pin end is configured to be received by a first bearing in a housing of the firearm, and the cover extension is configured to be received by a second bearing in the housing of the firearm.

9. The dust cover assembly of claim 8, wherein the first hole of the first bushing has a first diameter D1, the second hole of the second bushing has a second diameter D2, and the cover extension of the second bushing defines an internal hole extending in an axial direction having a diameter D3, wherein the diameter D3 is smaller than the diameter D2.

10. The dust cover assembly of claim 1, further comprising at least one sealing lip formed on the dust cover that is substantially complementary in shape to an ejection port of a housing of the firearm.

11. The dust cover assembly of claim 1, wherein the dust cover defines a spring bay that is complementary in shape to and receives an arm of the cover spring.

12. The dust cover assembly of claim 1, wherein the second hole of the second bushing is a blind hole.

13. The dust cover assembly of claim 2, wherein the first leg of the guide groove has a length in an axial direction of the pin in a range from 1/10 to 3/4 of the length of the first bushing.

14. The dust cover assembly of claim 2, wherein the first leg of the guide groove has a length in an axial direction of the pin in a range from 1/5 to 1/2 of the length of the first bushing.

15. The dust cover assembly of claim 2, wherein the guide groove limits an axial movement of the pin in the first bushing by a contact of the guide extension against an end stop of the first leg of the guide groove, the end stop being formed closer to an outer first end of the first bushing than to the second leg of the guide groove.

16. The dust cover assembly of claim 2, wherein the guide groove defined by the first bushing includes at least one mounting latch configured to temporarily lock the guide extension of the pin in the mounting position.

17. The dust cover assembly according to claim 4, further comprising an end pin disposed in the second hole at a second end of the second bushing, the end pin being directly connected to the pin spring.

18. A firearm, comprising:

a firearm housing defining an ejection port; and a dust cover assembly; the dust cover assembly comprising a dust cover including at least one sealing lip that is substantially complementary in shape to the ejection port;

a first bushing and a second bushing coupled to the dust cover in alignment with one another, the first bushing defining a first hole and the second bushing defining a second hole;

a pin, received in at least the first bushing, the pin defining an axis of rotation and including a pin end;

a cover extension formed on a second end of the second bushing; and a cover spring coiled around the pin between the first bushing and the second bushing;

wherein the pin is spring-preloaded in a direction along the axis of rotation, and is movable between a mounting position, a disassembling position, and an end position;

the pin includes a guide extension that extends from the pin in a radial direction;

the first bushing defines a guide groove, so that the guide extension of the pin extends into the guide groove and the pin is thereby guided between the end position and the mounting position;

the first bushing further defines an insertion groove on an inner surface of the first bushing, the insertion groove extending parallel to the axis of rotation of the pin, and beginning at an outer end of the first bushing and extending to and connecting with the guide groove, such that the insertion groove accommodates the guide extension of the pin when the pin is received by the first bushing; and wherein the pin end is received by a first bearing in the firearm housing, and the cover extension is received by a second bearing in the firearm housing.

19. The firearm of claim 18, wherein the guide groove is substantially L-shaped with two legs, a first leg of the guide groove being formed parallel to the axis of rotation of the pin and a second leg of the guide groove being formed in the direction perpendicular to the first leg, in a plane perpendicular to the axis of rotation.

20. The firearm of claim 19, wherein the guide groove limits an axial movement of the pin in the first bushing by a contact of the guide extension against an end stop of the first leg of the guide groove, the end stop being formed closer to an outer first end of the first bushing than to the second leg of the guide groove.

* * * * *